US005888103A

United States Patent [19]

Norizuki et al.

[11] Patent Number: 5,888,103

[45] Date of Patent: Mar. 30, 1999

[54] CRIMPING CONNECTOR AND METHOD OF PRODUCING THE SAME

[75] Inventors: Teruhisa Norizuki; Kimihiro Abe; Yuji Hatagishi; Tetsuya Yamashita, all of Shizuoka, Japan

[73] Assignee: Yazaki Corporation, Tokyo, Japan

[21] Appl. No.: 902,952

[22] Filed: Jul. 30, 1997

[30] Foreign Application Priority Data

Aug. 2, 1996 [JP] Japan ..... 8-204876

[51] Int. Cl.[6] ..... H01R 13/502

[52] U.S. Cl. ..... 439/701; 439/596

[58] Field of Search ..... 439/594–599, 439/603, 751, 752, 701, 877; 29/830, 842, 844

[56] References Cited

U.S. PATENT DOCUMENTS 5,201,674 4/1993 Okura ..... 439/595
5,286,225 2/1994 Tsuji ..... 439/717 X
5,700,163 12/1997 Okabe ..... 439/596

*Primary Examiner*—Khiem Nguyen
*Attorney, Agent, or Firm*—Sughrue, Mion, Zinn, Macpeak & Seas, PLLC

[57] ABSTRACT

There is disclosed a crimping connector in which the efficiency of the operation is enhanced by simplifying a process of crimping sheathed wires. Also the efficiency of arrangement of a terminal assembly in a mating connector is enhanced. Each of housings 10 and 11 includes an upwardly-open wire connecting portion 2 and a terminal connecting portion 3 of a closed cross-sectional shape communicating with the wire connecting portion 2, and the housings 10 and 11 are integrally connected together through hinges 4 so that the wire connecting portions 2 of the housings, as well as the terminal connecting portions 3 thereof, can be stacked one upon another vertically in the same position and the same direction, and also crimping terminals 30 in the stacked housings 10 and 11 are arranged vertically in the forward direction. Sheathed wires 40 are press-connected to the crimping terminals 30 in the housings 10 and 11 by a crimping jig 50 which moves upward and downward at the same position in the horizontal direction.

17 Claims, 7 Drawing Sheets

CRIMPING CONNECTOR AND METHOD OF PRODUCING THE SAME

BACKGROUND OF THE INVENTION

This invention relates to a crimping connector, and more particularly to a crimping connector having a terminal receiving portion for receiving crimping terminals connected respectively to many wires of electronic equipment, a wire harness in an automobile or the like.

One conventional crimping connector of the type described is disclosed in Japanese Utility Model Unexamined Publication No. 59-184476. As shown in FIG. 1, this crimping connector 100 comprises two housings 101 and 102 of an identical configuration integrally connected together through a thin hinge 105 at their adjacent sides in right-left symmetrical relation to other. Each of the housings 101 and 102 including an upwardly-open wire connecting portion 103 and a terminal connecting portion 104 of a closed cross-sectional shape communicating with the wire connecting portion 103 (see FIG. 1(*a*) and 1(*b*)). The wire connecting portion 103 has a plurality of juxtaposed receiving portions 107 separated from one another by a plurality of partition walls 106, and crimping terminals 108 are mounted in the receiving portions 107, respectively. The crimping terminal 108 is fitted in the receiving portion 107 in such a manner that part of this terminal 108 is inserted in the terminal connecting portion 104. As shown in FIG. 2, a plurality of terminal insertion ports 110 for respectively receiving male terminals (not shown) in a mating housing 400 are formed in one side surface 109 of the terminal connection portion 104, and correspond respectively to the receiving portions 107. Inserted ends of the crimping terminals 108, inserted in the terminal connecting portion 104, communicate with the terminal insertion ports 110, respectively.

Sheathed wires 200 are supplied to be disposed respectively above the crimping terminals 108, and are pressed downward by a crimping jig 300, and are press-fitted respectively into slots 111 formed respectively in the crimping terminals 108 (see FIG. 1(*b*)). As a result of this press-fitting operation, a sheath of each sheathed wire 200 is cut by opposite side edges of the slot 111, so that a conductor 201 of the sheathed wire 200 contacts the crimping terminal 108, and hence is press-connected thereto (see FIG. 1(*c*)).

After each sheathed wire 200 is thus connected to the associated crimping terminal 108, one 102 (or 101) of the housings is turned about the hinge 105 in a direction of an arrow, so that the open sides of the receiving portions 107 in the housing 101 are opposed and joined to the open sides in the housing 102 (see FIG. 1(*c*)), thereby obtaining the crimping connector 100 of a two-stage construction as shown in FIG. 2.

However, in the conventional crimping connector 100, after the sheathed wires 200 are press-connected relative to the one housing 101, the jig 300 or one of the housings 101 and 102 is horizontally moved, and then the sheathed wires 200 are press-connected relative to the other housing 102, and therefore there has been encountered a problem that the crimping process is complicated, so that the efficiency of the operation is lowered. Although it may be proposed to increase the jig 300 to such a large size that the jig 300 can cover the two housings 101 and 102, this increases the cost, and involves the high crimping force, and hence is not practical.

In the conventional crimping connector 100, when the two housings 101 and 102 are joined together, the lower-stage housing 101 and the upper-stage housing 102 are vertically inverted with respect to each other, and therefore the male terminals in the mating connector 400 need to be arranged in accordance with the arrangement of the crimping terminals 108, which has invited a problem that the efficiency of arrangement of a terminal assembly in the mating connector 400 is lowered.

More specifically, if each of the male terminals 401 in the mating connector 400 includes a contact terminal 402 having a joint portion 403 as shown in FIGS. 3(*a*) and 3(*b*), and the male terminals 401 for the upper and lower stages are arranged in the same forward direction in the mating connector 400, there inevitably occurs a condition in which the joint portions 403 contact resilient contact portions 112 of the crimping terminals 108, provided in the lower-stage housing 101 or the upper-stage housing 102 (see FIG. 4), when the mating connector 400 is fitted on the crimping connector 100. In this case, an electrically-insulating substance is liable to be produced at that portion of each joint portion 403 held in contact with the resilient contact portion 112, so that the electrically-contacted condition is not stable. Therefore, it is necessary to mount the terminal assembly of the mating connector 400 in such a manner that the terminal assembly will not be in the above contacted condition. As a result, there has been encountered a problem that the assembling operation is complicated, so that the efficiency of the operation is lowered.

SUMMARY OF THE INVENTION

The present invention has been made in order to overcome the above problems, and an object of the invention is to provide a crimping connector as well as a method of producing the same, in which the efficiency of the operation is enhanced by simplifying a process of crimping sheathed wires, and also the efficiency of arrangement of a terminal assembly in a mating connector is enhanced.

The above object of the invention has been achieved by a crimping connector according to the present invention which comprises:

- a plurality of housings each including an upwardly-open wire connecting portion and a terminal connecting portion of a closed cross-sectional shape communicating with the wire connecting portion; and
- a hinge for integrally connecting the housings so that the wire connecting portions of the housings, as well as the terminal connecting portions thereof, can be stacked one upon another vertically in the same position and the same direction.

With the above-mentioned crimping connector according to the present invention, when the housings are stacked together, the crimping terminals, mounted on the housings, are arranged vertically in the same position and the same forward direction, and therefore the sheathed wires can be press-connected to each of the housings by the crimping jig moving upward and downward at the same position, and besides terminals of a mating connector can be mounted thereon in the forward direction. Since the plurality of housings are integrally connected together through the hinges, the positioning operation of the housings with each other at the time of the stacking operation is not necessary.

The above-mentioned crimping connector according to the present invention may be modified in such a manner that a terminal insertion portion for the housing to be superposed on the lowermost housing is formed integrally with and extends upwardly from the terminal connecting portion of the lowermost housing. Thereby, variations in the fitting surfaces due to warpage of the housings and a play in the lock portions of the housings will not develop.

In addition, the above-mentioned crimping connector according to the present invention may be further modified in such a manner that the housing to be superposed on the lowermost housing is integrally connected to the terminal insertion portion through the hinge, and is disposed at an angle of about 90 degrees relative to the lowermost housing so that the obverse and reverse surfaces of the housing to be superposed on the lowermost housing can be directed respectively in directions of facing of the obverse and reverse surfaces of the lowermost housing. Accordingly, in this construction, the upper housing is held at an angle of about 90 degrees relative to the lower housing to open the wire connecting portion of the lower housing, so that the sheathed wires can be press-connected to the wire connecting portion, and after the crimping operation, the upper housing can be pivotally moved about 90 degree to be superposed on the lower housing.

Further, the above-mentioned crimping connector according to the present invention may be modified in such a manner that the plurality of housings are integrally connected together through the hinges in such a manner that any two adjacent housings are disposed at an angle of about 180 degrees with respect to each other in a direction perpendicular to a direction of a length of crimping terminals mounted on the housings, and are disposed in inverted relation to each other. Accordingly, in this construction, the upper housing is held at an angle of about 180 degrees relative to the lower housing to open the wire connecting portion of the lower housing, so that the sheathed wires can be press-connected to the wire connecting portion, and after the crimping operation, the upper housing can be pivotally moved about 180 degrees to be superposed on the lower housing.

Furthermore, the above-mentioned crimping connector according to the present invention may be modified in such a manner that a cover for covering an upper side of the wire connecting portion of the housing to be disposed in an uppermost stage is integrally connected to the uppermost housing through a hinge portion. Accordingly, in this construction, when covering the upper side of the wire connecting portion of the uppermost housing, an operation of registering the cover with the housing is not necessary.

However, the above-mentioned crimping connector according to the present invention may be modified in such a manner that the plurality of housings and the cover are integrally connected together through the hinge and the hinge portion so that they can be pivotally moved in the same direction to be stacked together. Accordingly, in this construction, the plurality of housings and the cover can be sequentially stacked together by repeating the operation in the same direction.

In addition, the above-mentioned crimping connector according to the present invention may be modified in such a manner that the cover is provided with a projection which is pressed against sheathed wires, connected to the uppermost housing, when the cover covers the wire connecting portion of the uppermost housing. Accordingly, in this construction, the cover covers the wire connecting portion, and the projection, formed on the lower surface of the cover, is pressed against the sheathed wires connected to the wire connecting portion, and therefore the resistance against a pulling force, acting on the sheathed wires, is increased, thereby enhancing the wire holding force.

Further, the above-mentioned crimping connector according to the present invention may be modified in such a manner that a projection is formed on each of the plurality of housings except the lowermost housing, and each of the projections is pressed against sheathed wires connected to the housing disposed beneath the projection when the plurality of housings are stacked together. Accordingly, in this construction, the projection, formed on the housing, is pressed against the sheathed wires connected to the housing disposed beneath the projection when the housings are stacked together, and therefore the resistance against a pulling force, acting on the sheathed wires, is increased, thereby enhancing the wire holding force.

The above object of the invention has also been achieved by a method of producing a crimping connector comprising: a plurality of housings each including an upwardly-open wire connecting portion and a terminal connecting portion of a closed cross-sectional shape communicating with the wire connecting portion; and a hinge for integrally connecting the housings so that the wire connecting portions of the housings, as well as the terminal connecting portions thereof, can be stacked one upon another vertically in the same position and the same direction, the method comprising the following steps in the sequence set forth:

crimping sheathed wires to the wire connecting portion of the lower housing from an upper side;

turning the upper housing to be superposed on the lower housing; and crimping sheathed wires to the wire connecting portion of the upper housing from an upper side.

In the above-mentioned method according to the present invention, after the sheathed wires are press-connected to the wire connecting portion of the lower housing from the upper side, using a crimping jig moving upward and downward at the same position, the upper housing is turned to be superposed on the lower housing, and then the sheathed wires can be press-connected to the wire connecting portion of the upper housing, using the crimping jig.

BRIEF DESCRIPTION OF THE DRAWINGS

FIG. 3(*b*) is a cross-sectional view taken along the line A—A of FIG. 3(*a*);

DESCRIPTION OF THE PREFERRED EMBODIMENTS OF THE INVENTION

A preferred embodiment of the present invention will now be described with reference to the drawings.

Figure 1A:
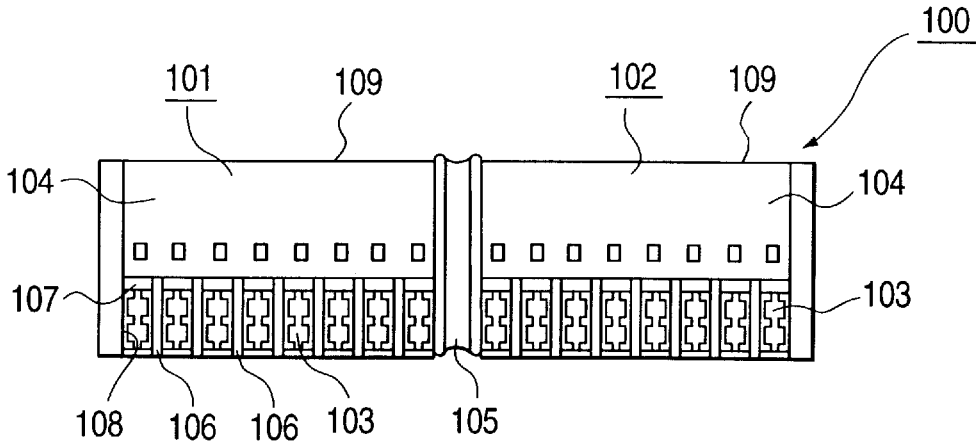
FIGS. 1(*a*)–(*c*) show a process of assembling a conventional crimping connector, FIG. 1(*a*) being a plan view showing the step of mounting crimping terminals on housings, FIG. 1(*b*) being a side-elevational view showing the step of crimping sheathed wires respectively to the crimping terminals shown in FIG. 1(*a*), and FIG. 1(*c*) being a side-elevational view showing the conventional crimping connector having the housings joined together in a stacked manner.
Figure 1B:
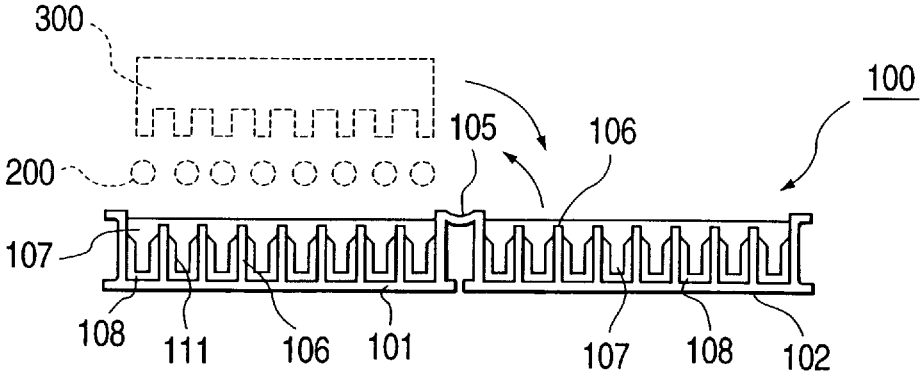
Figure 1C:
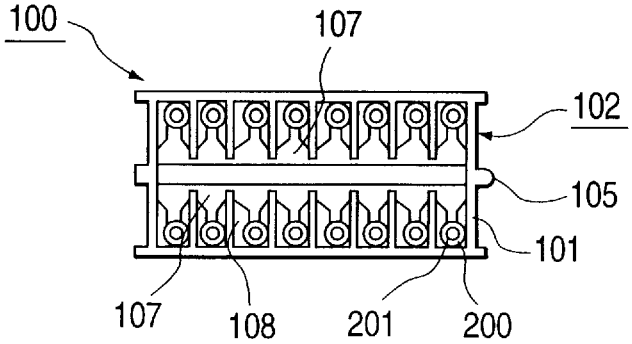
Figure 2:
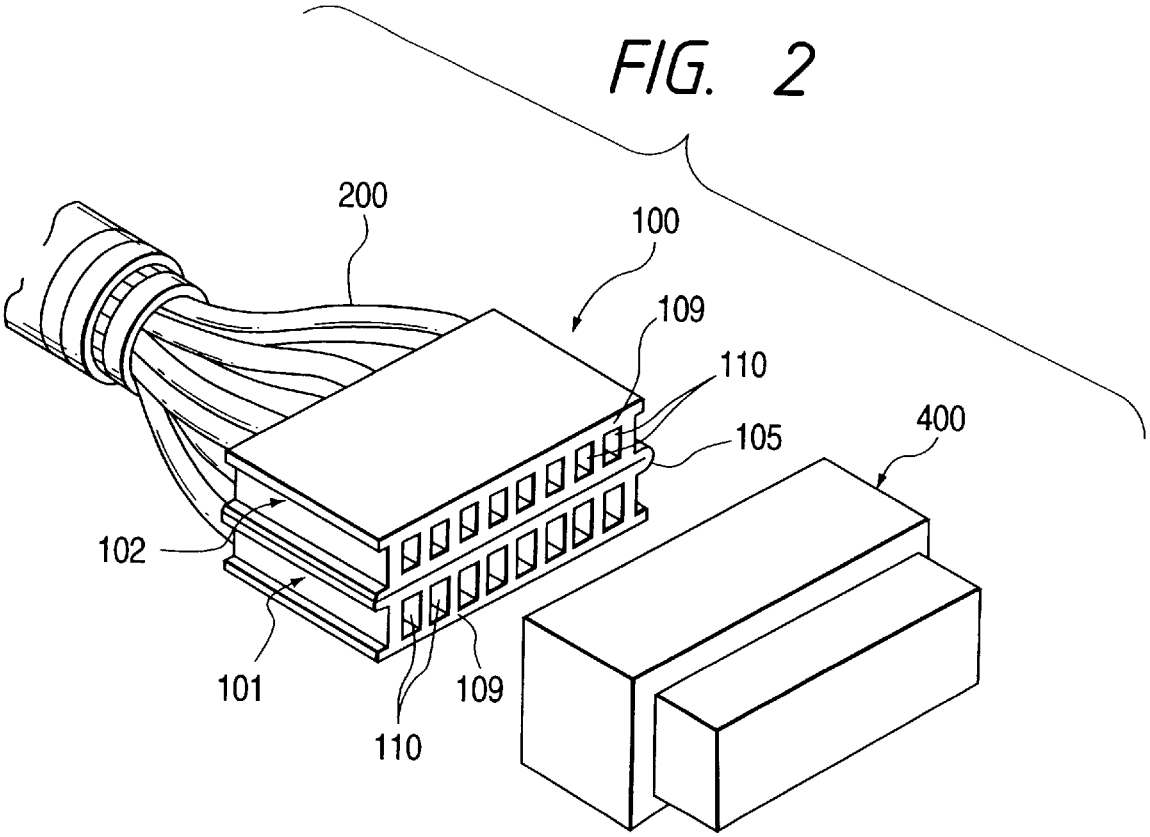
FIG. 2 is a perspective view showing the conventional crimping connector of FIG. 1 and a mating connector to be fitted on this crimping connector.
Figure 3A:
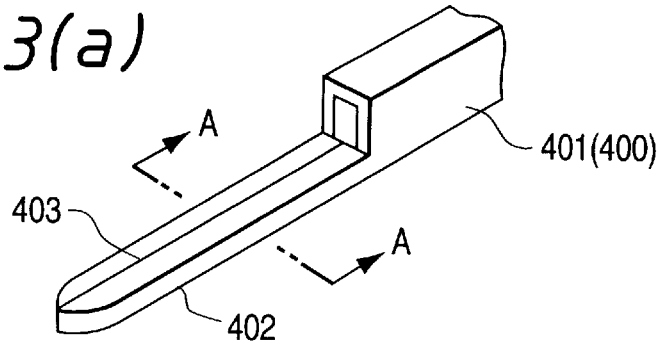
FIG. 3(*a*) is a perspective view showing an important portion of a male terminal in the mating connector.
Figure 3B:
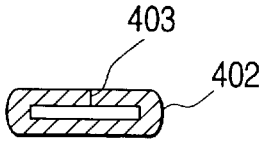
Figure 4:
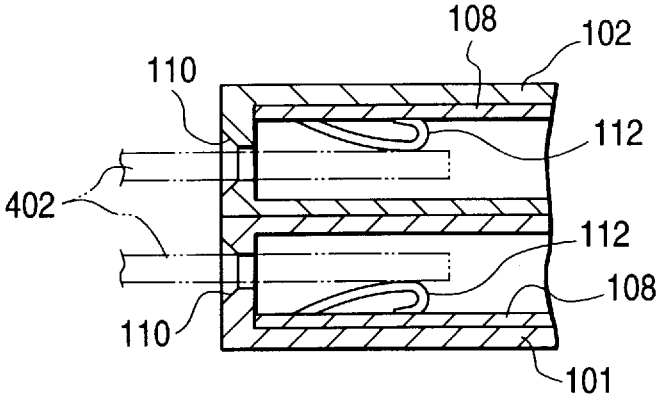
FIG. 4 is a cross-sectional view showing a condition in which the male terminals of the mating connector are inserted into the conventional crimping connector.
Figure 5:
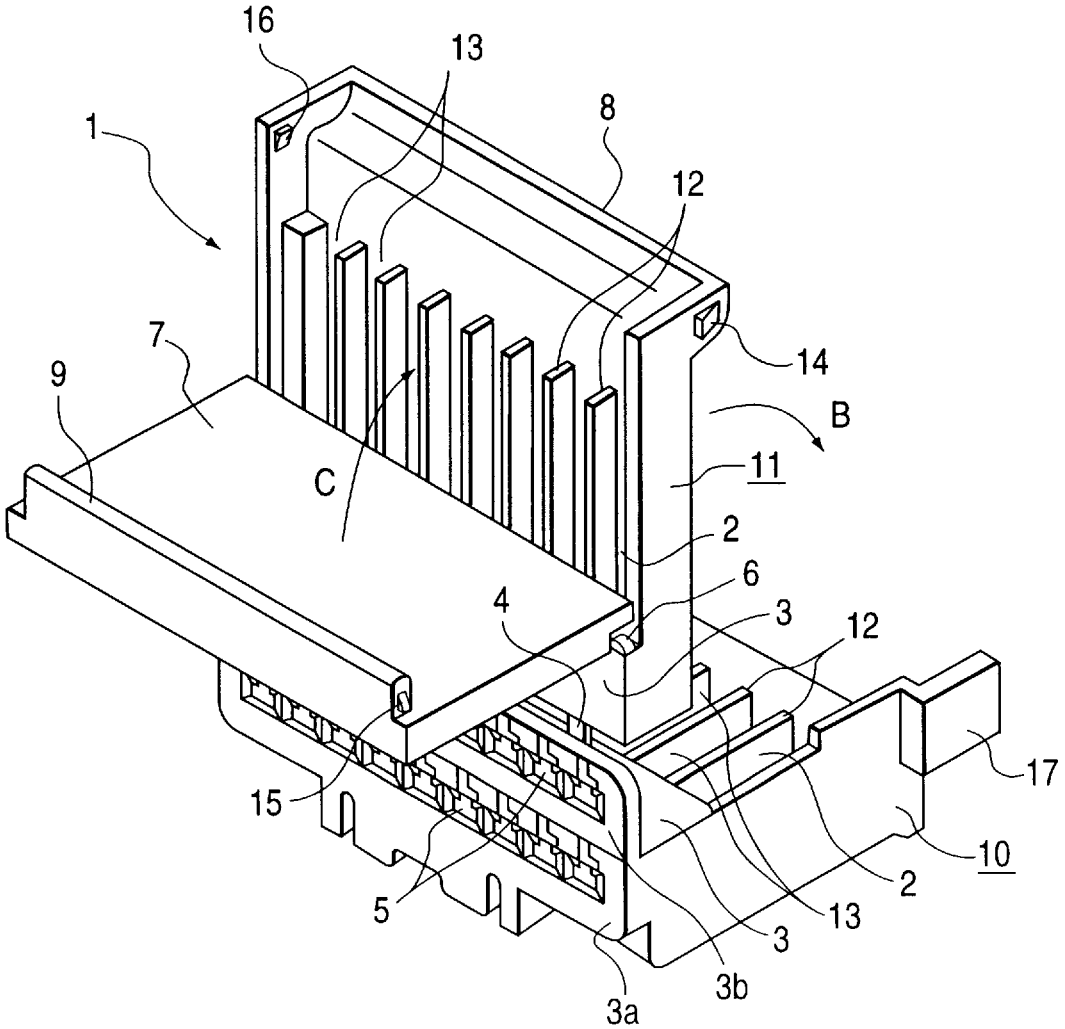
FIG. 5 is a perspective view of a housing used in one preferred embodiment of a crimping connector of the invention.

FIG. 5 shows a housing 1 used in one preferred embodiment of a crimping connector of the invention. This housing 1 comprises a lower-stage housing 10 and an upper-stage housing 11 each including an upwardly-open wire connecting portion 2 and a terminal connecting portion 3 of a closed cross-sectional shape communicating with the wire connecting portion 2. The housings 10 and 11 are integrally connected together through hinges 4 so that the wire connecting portions 2 of the two housings 10 and 11, as well as the terminal connecting portions 3 thereof, can be stacked together vertically in the same horizonal position and the same direction.

A terminal insertion portion 3*b* of the upper-stage housing 11 extends upwardly from a terminal insertion portion 3*a* of the terminal connecting portion 3 of the lower-stage housing 10, and a plurality of openings 5 for respectively receiving male terminals (not shown) of a mating connector are formed in each of the terminal insertion portions 3*a* and 3*b*.

The upper-stage housing 11 is integrally connected to an upper edge of the terminal insertion portion 3*b* through the hinges 4, and is disposed at an angle of about 90 degrees relative to the lower-stage housing 10 so that the obverse and reverse surfaces of the housing 11 can be directed respectively in the directions of facing of the obverse and reverse surfaces of the housing 10. A projection 8 is formed on and projects downwardly (horizontally in FIG. 5) from an edge of the wire connecting portion 2 of the upper-stage housing 11, and a cover 7 for covering the wire connecting portion 2 is integrally connected to an edge of the terminal connecting portion 3 of the upper-stage housing 11.

A projection 9 is integrally formed on and projects downwardly (upwardly in FIG. 5) from an edge of the cover 7 remote from the hinges 6, and the cover 7 is connected to the upper-stage housing 11 at an angle of about 90 degrees.

The wire connecting portion 2 of each of the upper-stage and lower-stage housings 10 and 11 has a plurality of terminal receiving portions 13 separated from one another by a plurality of parallel partition walls 12.

The housing 1, including the lower-stage and upper-stage housings 10 and 11, the cover 7 and the above-mentioned connecting structures, is formed into an integral construction, using an electrically-insulating resin.

Retaining pawls 14 are formed on the upper-stage housing 11, and retaining pawls 15 are formed on the cover 7, and when the upper-stage housing 11 is turned to be superposed on the lower-stage housing 10, the retaining pawls 14 are retainingly engaged respectively with retaining portions 17 of the lower-stage housing 10, thereby maintaining the superposed condition of the upper-stage housing 11. When the cover 7 is turned to be superposed on the upper-stage housing 11 to thereby cover the upper side of the wire connecting portion 2, the retaining pawls 15 are retainingly engaged respectively with retaining projections 16 on the upper-stage housing 11, thereby maintaining the superposed condition of the cover 7.

Figure 6:
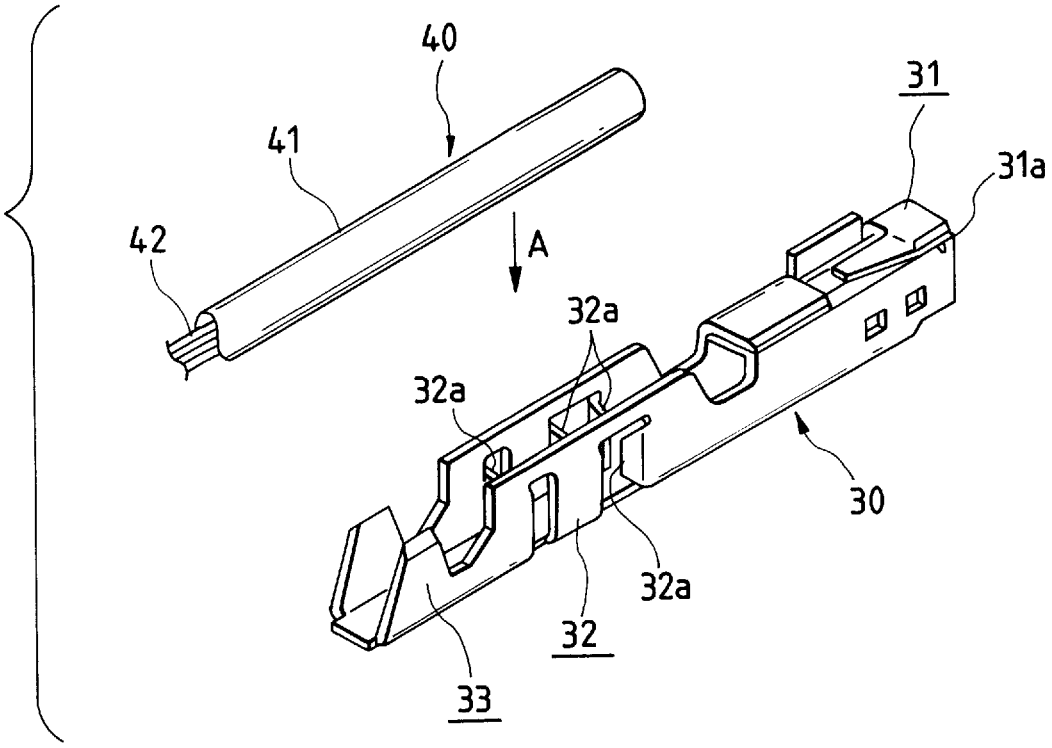
FIG. 6 is a perspective view of a crimping terminal to be mounted on the housing of FIG. 5.

FIG. 6 shows a crimping terminal 30 used in this embodiment. This crimping terminal 30 includes a contact 31 for receiving the male terminal (not shown) to make electrical contact therewith, a crimping portion 32, and a wire holding portion 33 disposed adjacent to one end of the crimping portion 32 remote from the contact 31. When a sheathed wire 40 is pressed into the crimping portion 32 in a direction of arrow A (FIG. 6), crimping blades 32*a* cut a sheath 41 to make electrical contact with a conductor 42. The wire holding portion 33 is bent inwardly to fixedly hold the sheathed wire 40 around the sheath 41.

The crimping terminals 30 are mounted on the lower-stage and upper-stage housings 10 and 11 in such a manner that the contact 31 of each crimping terminal 30 is inserted into the terminal connecting portion 3 while the crimping portion 32 and the wire holding portion 33 are fitted in the associated terminal receiving portion 13.

In this mounted condition, openings 31*a*, formed respectively in the contacts 31 of the crimping terminals 30 mounted on the lower-stage housing 10, are disposed respectively in correspondence with the openings 5 in the terminal insertion portion 3*a*, and when the upper-stage housing 11 is turned to be superposed on the lower-stage housing 10, openings 31*a*, formed respectively in the contacts 31 of the crimping terminals 30 mounted on the upper-stage housing 11, are respectively disposed in correspondence with the openings 5 in the terminal insertion portion 3*b*. In this construction, each male terminal (not shown) of the mating connector is inserted into the associated opening 5 in the terminal insertion portion 3*a*, 3*b*, and is inserted into the associated contact 31 through the opening 31*a*, thereby making an electrical connection between the male terminal and the crimping terminal 30.

The sheathed wires 40 are attached respectively to the crimping terminals 30 mounted on the lower-stage and upper-stage housings 10 and 11. This attaching operation will be described with reference to FIGS. 7 to 9.

A crimping jig 50, used for this attaching operation, includes a press piece portion 52 for downward movement in correspondence with the crimping blades 32*a* so as to press the sheathed wire 40 into the crimping terminal 30, a cramper 51 which is formed integrally with the press piece portion 52, and is downwardly movable in correspondence with the wire holding portion 33 of the crimping terminal 30 so as to inwardly bend the wire holding portion 33, and guide plates 53 which are provided respectively on opposite sides of the press piece portion 52, and are vertically movable so as to prevent the crimping blades 32*a* from being excessively opened during the pressing operation.

Figure 8:
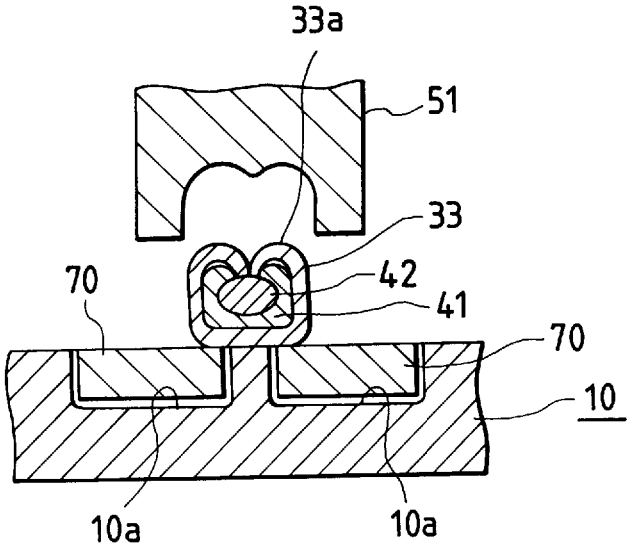
FIG. 8 is a cross-sectional view showing the step of crimping the sheathed wire to a wire holding portion of the crimping terminal during the crimping connector assembling process of FIG. 7.
Figure 7A:
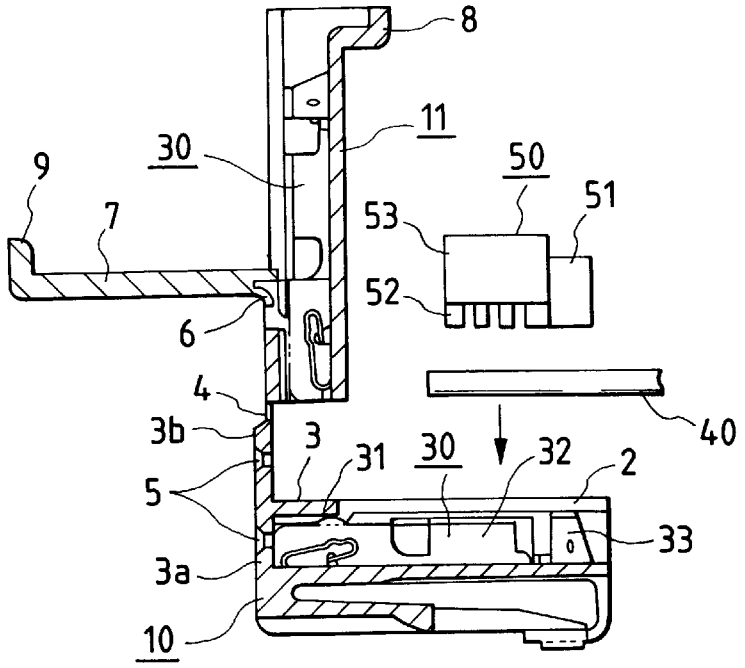
FIGS. 7(*a*)–(*c*) shows a process of assembling the crimping connector of the above embodiment, FIG. 7(*a*) being a cross-sectional view showing the step of crimping sheathed wires to a lower-stage housing, FIG. 7(*b*) being a cross-sectional view showing the step of crimping sheathed wires to an upper-stage housing, and FIG. 7(*c*) being a cross-sectional view showing the step of mounting a cover.
Figure 7B:
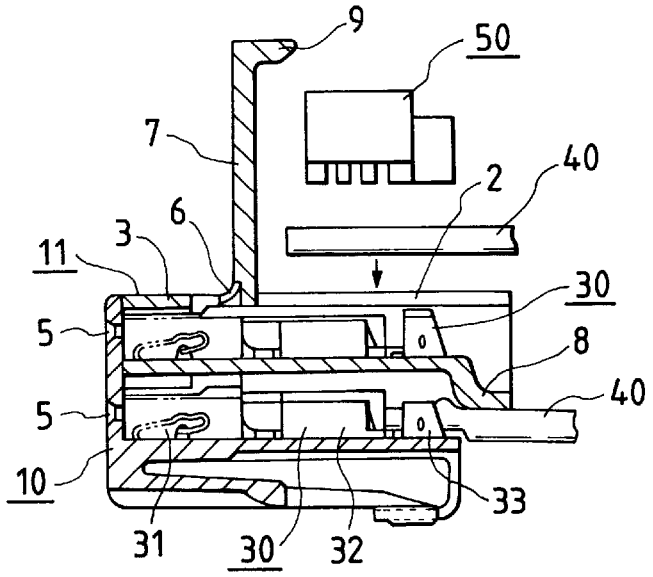
Figure 7C:
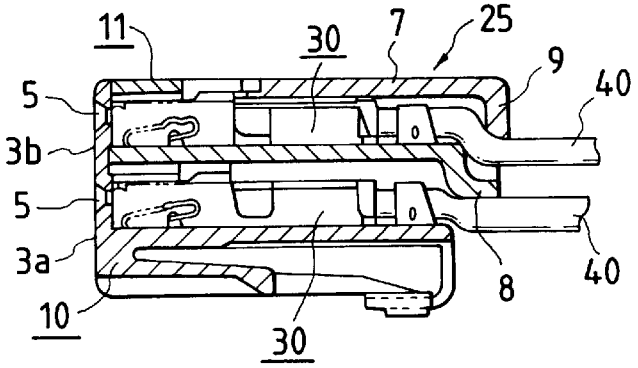
Figure 9:
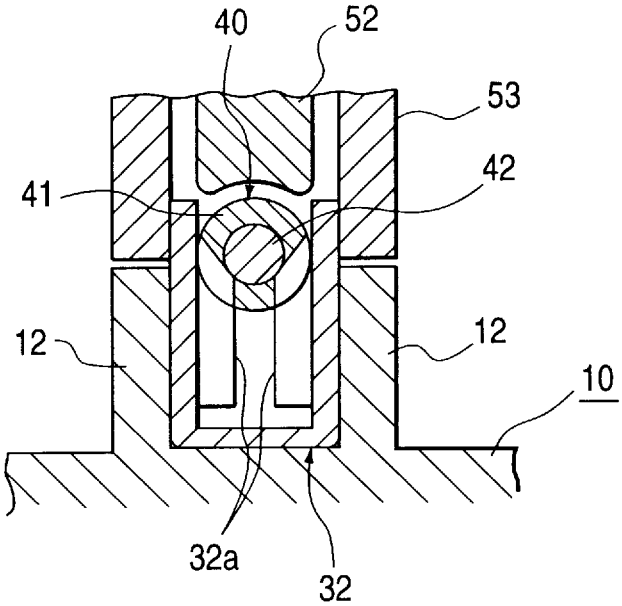
FIG. 9 is a cross-sectional view showing the step of crimping the sheathed wire to a crimping portion of the crimping terminal during the crimping connector assembling process of FIG. 7.

First, the sheathed wires 40 are attached respectively to the crimping terminals 30 mounted on the lower-stage housing 10 (see FIG. 7(*a*)). At this time, the wire connecting portion 2 of the lower-stage housing 10 is open upwardly, and is held in a horizontal condition, and the upper-stage housing 11 is held at an angle of about 90 degrees relative to the lower-stage housing 10, and also the cover 7 is held at an angle of about 90 degrees relative to the upper-stage housing 11, and the sheathed wire 40 is placed on the crimping terminal 30 on the lower-stage housing 10. In this condition, when the crimping jig 50 is moved downward, the cramper 51 cooperates with a jig receiving member 70 to inwardly bend the upright wire holding portion 33 to thereby clamp the sheathed wire 40 in such a manner that distal ends 33*a* of the wire holding portion 33 pierce the sheath 41 of the sheathed wire 40 to make electrical contact with the conductor 42, as shown in FIG. 8. The press piece portion 52, moving together with the cramper 51, presses the sheathed wire 40 into the crimping terminal 30, so that the crimping blades 32*a* cut the sheath 41 to make electrical contact with the conductor 42, as shown in FIG. 9.

The jig receiving member 70 has a comblike configuration so that it can be fitted in notched recesses 10*a* formed in that end portion of the wire connecting portion 2 of the lower-stage housing 10 remote from the terminal connecting portion 3.

After the sheathed wires 40 are thus connected to the lower-stage housing 10, the upper-stage housing 11 is pivotally moved about the hinges 4 in a direction of arrow B (FIG. 5) to be superposed on the lower-stage housing 10. In this stacked condition, the wire connecting portions 2 of the lower-stage and upper-stage housings 10 and 11, as well as the terminal connecting portions 3 thereof, are stacked together vertically in the same position and the same direction as shown in FIG. 7(*b*), and also the crimping terminals 30 in the housings 10 and 11 are arranged vertically in the same forward direction. The cover 7 is held at an angle of about 90 degrees relative to the upper-stage housing 11, and the projection 8, projecting downwardly from the upper-stage housing 11, is pressed against the sheathed wires 40 connected to the lower-stage housing 10.

In this stacked condition, the sheathed wires 40 are connected to the upper-stage housing 11. At this time, the wire connecting portions 2 of the lower-stage and upper-stage housings 10 and 11 are stacked together vertically in the same position and the same direction, and the crimping terminals 30 on the housings 10 and 11 are arranged in the forward direction, as described above, and therefore by moving the crimping jig 50, which has press-connected the sheathed wires 40 to the lower-stage housing 10, upward and downward at the same position as described above, the sheathed wires 40 can be press-connected respectively to the crimping terminals 30, mounted on the upper-stage housing 11, in the same manner as described for the lower-stage housing 10. The stroke of the crimping jig 50 in the upward-downward direction at this time is shorter than that at the time of the crimping operation for the lower-stage housing.

After the sheathed wires 40 are connected to the upper-stage housing 11, the cover 7 is pivotally moved about the hinges 6 in a direction of arrow C (FIG. 5) to be superposed on the upper-stage housing 11. In this superposed condition, the cover 7 covers the upper side of the wire connecting portion 2 of the upper-stage housing 11, and the projection 9, formed on the cover 7, is pressed against the sheathed wires 40 connected to the upper-stage housing 11, as shown in FIG. 7(*c*).

In this manner, the assembling of the crimping connector 25 of this embodiment is completed.

In the crimping connector 25, when the housings 10 and 11 are stacked together, the crimping terminals 30, mounted on the housings 10 and 11, are arranged vertically in the same position and the forward direction, and therefore the sheathed wires 40 can be press-connected to each of the lower-stage and upper-stage housings by the crimping jig 50 moving upward and downward at the same position, and besides the terminals of the mating connector can be mounted thereon in the forward direction. Therefore, in the crimping connector 25, the process of crimping the sheathed wires 40 is simplified, so that the efficiency of the operation can be enhanced, and also the efficiency of arranging a terminal assembly in the mating connector can be enhanced.

In the crimping connector 25, the housings 10 and 11 and the cover 7 are integrally connected together through the hinges 4 and 6, and therefore any registration operation for the parts is not necessary at the time of the stacking operation, and this enhances the efficiency of the operation.

In the crimping connector 25, the terminal insertion portion 3*b* for the upper-stage housing 11 is integrally formed on and extends from the terminal insertion portion 3*a* of the terminal connecting portion 3 of the lower-stage housing 10, and therefore variations in the fitting surfaces (that is, the outer surfaces of the terminal insertion portions 3*a* and 3*b*) due to warpage of the housings 10 and 11 and a play in the lock portions of the housings 10 and 11 will not develop, so that the highly-precise fitting surfaces can be formed.

In the crimping connector 25, the direction (direction B) of pivotal movement of the upper-stage housing 11 is the same as the direction (direction C) of pivotal movement of the cover 7, and these can be stacked sequentially by repeating the operation in the same direction, and therefore the stacking operation can be simplified, and besides the angle of pivotal movement of each of the upper-stage housing 11 and the cover 7 is as small as 90 degrees, and therefore the efficiency of the operation can be enhanced.

In the crimping connector 25, the projection 9, formed on the cover 7, is pressed against the sheathed wires 40, connected to the upper-stage housing 11, in the superposed condition of the cover 7, and also the projection 8, formed on the upper-stage housing 11, is pressed against the sheathed wires 40, connected to the lower-stage housing 10, in the superposed condition of the upper-stage housing 11, and therefore the resistance against a pulling force, acting on the sheathed wires 40, is increased, thereby enhancing the wire holding force. Therefore, any other press member for the sheathed wires 40 is not necessary, and the stably-connected condition of the sheathed wires 40 can be obtained without increasing the number of the component parts.

Figure 10:
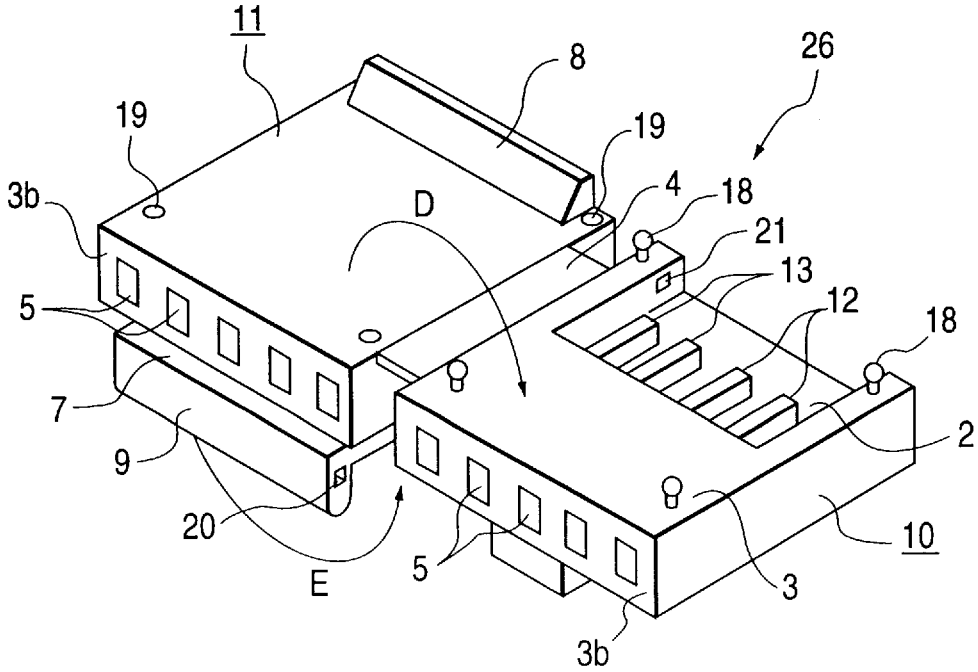
FIG. 10 is a perspective view of a housing used in another embodiment of a crimping connector of the invention.

FIG. 10 shows a housing 26 used in another embodiment of a crimping connector. Like the above-mentioned housing 1, this housing 26 comprises a lower-stage housing 10 and an upper-stage housing 11 each including an upwardly-open wire connecting portion 2 and a terminal connecting portion 3 of a closed cross-sectional shape communicating with the wire connecting portion 2. The housings 10 and 11 are integrally connected together through a hinge 4 so that the wire connecting portions 2 of the two housings 10 and 11, as well as the terminal connecting portions 3 thereof, can be stacked together vertically in the same position and the same direction.

Figure 11A:
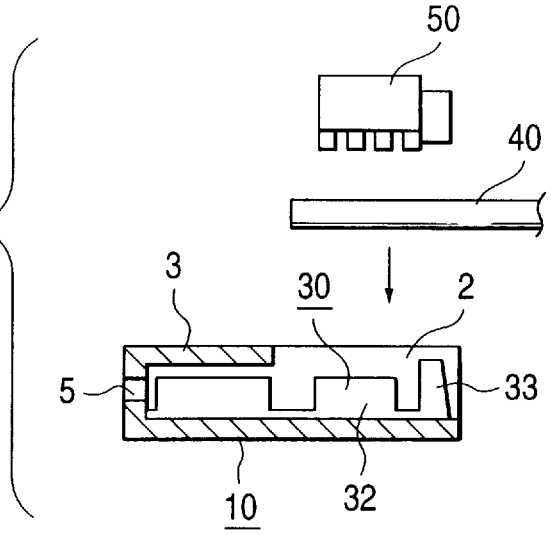
FIGS. 11(*a*)–(*c*) show a process of assembling the crimping connector of the above embodiment, FIG. 11(*a*) being a cross-sectional view showing the step of crimping sheathed wires to a lower-stage housing, FIG. 11(*b*) being a cross-sectional view showing the step of crimping sheathed wires to an upper-stage housing, and FIG. 11(*c*) being a cross-sectional view showing the step of mounting a cover.
Figure 11B:
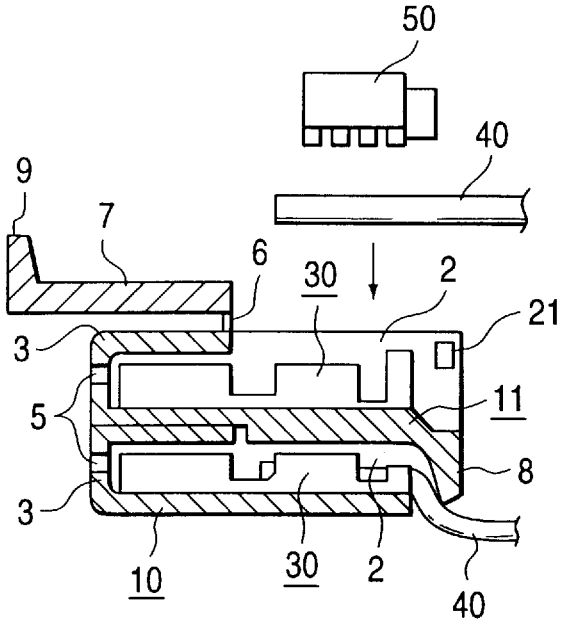
Figure 11C:
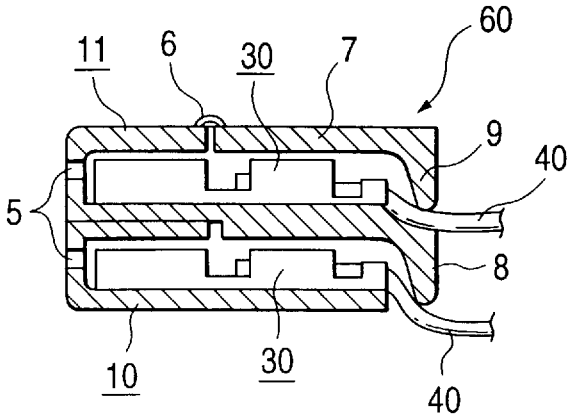

This housing 26 differs from the housing 1 only in that the housings 10 and 11 are integrally connected together through the hinge 4 in such a manner that the two housings 10 and 11 are disposed at an angle of about 180 degrees with respect to each other in a direction perpendicular to a direction of the length of crimping terminals 30 mounted on the housings 10 and 11, and are disposed in inverted relation to each other, that terminal insertion portions 3a and 3b are provided respectively at the housings 10 and 11, and that a cover 7 is connected through a hinge 6 (see FIG. 11(*b*)) to the upper-stage housing 11 at an angle of about 180 degrees in such a manner that the cover 7 can be turned in a direction (direction E) perpendicular to a direction (direction D) of pivotal movement of the upper-stage housing 11 so as to be superposed on the upper-stage housing 11. The other construction of the housing 26 is similar to that of the housing 1. In this embodiment, the lower-stage housing 10 is disposed with its obverse side directed upwardly while the upper-stage housing 11 is turned over.

Those constituent elements identical to those of the above embodiment will be designated by identical reference numerals, respectively, and explanation thereof will be omitted.

In FIG. 10, engagement projections 18 are formed on the lower-stage housing 10, and engagement projections 20 are formed on the cover 7. When the upper-stage housing 11 is turned to be superposed on the lower-stage housing 10, the engagement projections 18 are engaged respectively in engagement recesses 19 in the upper-stage housing 10, thereby maintaining the superposed condition of the upper-stage housing 11. When the cover 7 is turned to be superposed on the upper-stage housing 11 to thereby cover the upper side of the wire connecting portion 2, the engagement projections 20 are engaged respectively in engagement recesses 21 (see FIG. 11(*b*)) formed respectively in opposite side walls of the wire connecting portion 2 of the upper-stage housing 11, thereby maintaining the superposed condition of the cover 7.

The housing 26, including the lower-stage and upper-stage housings 10 and 11, the cover 7 and the above-mentioned connecting structures, is formed into an integral construction, using an electrically-insulating resin.

The crimping terminals 30 are mounted on the housing 26, and sheathed wires 40 are press-connected to the crimping terminals 30, respectively. In this embodiment, the crimping of the sheathed wires 40 is effected using a crimping jig 50 as described above for the preceding embodiment, and this crimping process is effected as shown in FIG. 11.

More specifically, first, in a free condition (FIG. 10) of the housing 26, the sheathed wires 40 are press-connected respectively to the crimping terminals 30 in the wire connecting portion 2 of the lower-stage housing 10 (see FIG. 11(*a*)). After the sheathed wires are connected to the lower-stage housing 10, the upper-stage housing 11 is pivotally moved about the hinge 4 in the direction of arrow D (see FIG. 10) to be superposed on the lower-stage housing 10. In this stacked condition, the wire connecting portions 2 of the lower-stage and upper-stage housings 10 and 11, as well as the terminal connecting portions 3 thereof, are stacked together vertically in the same position and the same direction as shown in FIG. 11(*b*), and also the crimping terminals 30 in the housings 10 and 11 are arranged vertically in the same forward direction. The cover 7 is held at an angle of about 180 degrees relative to the upper-stage housing 11, and a projection 8, projecting downwardly from the upper-stage housing 11, is pressed against the sheathed wires 40 connected to the lower-stage housing 10.

In this stacked condition, the sheathed wires 40 are connected to the upper-stage housing 11. At this time, the wire connecting portions 2 of the lower-stage and upper-stage housings 10 and 11 are stacked together vertically in the same position and the same direction, and the crimping terminals 30 on the housings 10 and 11 are arranged in the forward direction, as described above, and therefore by moving the crimping jig 50, which has press-connected the sheathed wires 40 to the lower-stage housing 10, upward and downward at the same position, the sheathed wires 40 can be press-connected respectively to the crimping terminals 30, mounted on the upper-stage housing 11, in the same manner as described for the lower-stage housing 10.

After the sheathed wires 40 are connected to the upper-stage housing 11, the cover 7 is pivotally moved about the hinge 6 in the direction of arrow E (FIG. 10) to be superposed on the upper-stage housing 11. In this superposed condition, the cover 7 covers the upper side of the wire connecting portion 2 of the upper-stage housing 11, and a projection 9, formed on the cover 7, is pressed against the sheathed wires 40 connected to the upper-stage housing 11, as shown in FIG. 11(*c*).

In this manner, the assembling of the crimping connector 60 of this embodiment is completed.

In the crimping connector 60, when the housings 10 and 11 are stacked together, the crimping terminals 30, mounted on the housings 10 and 11, are arranged vertically in the same position and the forward direction, and therefore the sheathed wires 40 can be press-connected to each of the lower-stage and upper-stage housings by the crimping jig 50 moving upward and downward at the same position, and besides terminals of a mating connector can be mounted thereon in the forward direction. Therefore, in the crimping connector 60, the process of crimping the sheathed wires 40 is simplified, so that the efficiency of the operation can be enhanced, and also the efficiency of arranging a terminal assembly in the mating connector can be enhanced.

In the crimping connector 60, the housings 10 and 11 and the cover 7 are integrally connected together through the hinges 4 and 6, and therefore any registration operation for the parts is not necessary at the time of the stacking operation, and this enhances the efficiency of the operation.

In the crimping connector 60, the projection 9, formed on the cover 7, is pressed against the sheathed wires 40, connected to the upper-stage housing 11, in the superposed condition of the cover 7, and also the projection 8, formed on the upper-stage housing 11, is pressed against the sheathed wires 40, connected to the lower-stage housing 10, in the superposed condition of the upper-stage housing 11, and therefore the resistance against a pulling force, acting on the sheathed wires 40, is increased, thereby enhancing the wire holding force. Therefore, any other press member for the sheathed wires 40 is not necessary, and the stably-connected condition of the sheathed wires 40 can be obtained without increasing the number of the component parts.

In the crimping connector 60, the lower-stage and upper-stage housings 10 and 11 are integrally connected together horizontally by the hinge 4 to be disposed in a plane, and therefore the molding of this connector can be effected more easily as compared with the preceding embodiment of a vertically-expanded construction.

With this construction of the crimping connector 60, it can be easily molded even if the number of the housings is increased to three or more.

In a method of producing the crimping connector 25, 60, the sheathed wires 40 can be press-connected respectively to the crimping terminals 30 by the crimping jig 50 which is not moved horizontally, but is moved vertically at the same position, and therefore the crimping process is simplified, so that the efficiency of the operation is enhanced.

The present invention is not limited to the above embodiments, but can be applied to a connector having three or more housings, in which case similar effects can be achieved.

As described above in detail, the following advantageous effects are achieved by the crimping connector and a method of producing the same according to the present invention:

In the crimping connector according to the present invention, the sheathed wires can be press-connected respectively to the crimping terminals in each of the housings by the crimping jig moving upward and downward at the same position, and besides the terminals of the mating connector can be mounted thereon in the forward direction. As a result, the efficiency of the operation can be enhanced by the simplified process of crimping the sheathed wires, and the efficiency of arranging the terminal assembly of the mating connector is enhanced. And besides, since the plurality of housings are integrally connected together through the hinges, the registration of the housings with each other at the time of the stacking operation is not necessary.

In the crimping connector according to the present invention, the terminal insertion portion is formed integrally with and extends upwardly from the terminal connecting portion of the lowermost housing, and therefore variations in the fitting surfaces due to warpage of the housings and a play in the lock portions of the housings will not develop, so that the highly-precise fitting surfaces can be formed.

In the crimping connector according to the present invention, the upper housing can be pivotally moved about 90 degrees to be superposed on the lower housing, and therefore the angle of this pivotal movement is small, thereby enhancing the efficiency of the operation. The plurality of housings are integrally connected together through the hinges to be disposed in juxtaposed relation to one another, and therefore the connector can be easily molded even if the number of the housings is increased.

In the crimping connector according to the present invention, the cover for covering the upper side of the wire connecting portion of the housing to be disposed in the uppermost stage is integrally connected to the uppermost housing through a hinge portion, and therefore when covering the upper side of the wire connecting portion of the uppermost housing, an operation of registering the cover with the housing is not necessary, so that the efficiency of the operation is enhanced.

In the crimping connector according to the present invention, the plurality of housings and the cover can be sequentially stacked together by repeating the operation in the same direction, and therefore the operation is simplified, thereby enhancing the efficiency of the operation.

In the crimping connector according to the present invention, the projection, formed on the lower surface of the cover which covers the upper side of the wire connecting portion, is pressed against the sheathed wires connected to the wire connecting portion, thereby enhancing the wire holding force, and therefore the stably-connected condition of the sheathed wires can be obtained without increasing the number of the component parts.

In the crimping connector according to the present invention, the projection, formed on the lower surface of the housing, is pressed against the sheathed wires connected to the housing disposed beneath the projection when the housings are stacked together, thereby enhancing the wire holding force, and therefore the stably-connected condition of the sheathed wires can be obtained without increasing the number of the component parts.

In the crimping connector according to the present invention, after the sheathed wires are press-connected to the wire connecting portion of the lower housing from the upper side, using the crimping jig moving upward and downward at the same position, the upper housing is turned to be superposed on the lower housing, and then the sheathed wires can be press-connected to the wire connecting portion of the upper housing, using the crimping jig. Therefore, there can be provided the method of producing the crimping connector in which the efficiency of the operation is enhanced by simplifying the process of crimping the sheathed wires.

The foregoing description of preferred embodiments of the invention has been presented for purposes of illustration and description. It is not intended to be exhaustive or to limit the invention to the precise from disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A crimping connector comprising:

a plurality of housings each including an upwardly-open wire connecting portion and a terminal connecting portion of a closed cross-sectional shape communicating with said wire connecting portion; and a hinge for integrally connecting said housings so that said wire connecting portions of said housings, as well as said terminal connecting portions thereof, can be stacked one upon another vertically in the same position and the same direction.

2. A crimping connector according to claim 1, in which a terminal insertion portion for said housing to be superposed on the lowermost housing is formed integrally with and extends upwardly from said terminal connecting portion of said lowermost housing.

3. A crimping connector according to claim 2, in which said housing to be superposed on said lowermost housing is integrally connected to said terminal insertion portion through said hinge, and is disposed at an angle of about 90 degrees relative to said lowermost housing so that the obverse and reverse surfaces of said housing to be superposed on said lowermost housing can be directed respectively in the same directions that the obverse and reverse surfaces of said lowermost housing face.

4. A crimping connector according to claim 1, in which said plurality of housings are integrally connected together through said hinge in such a manner that any two adjacent housings are disposed at an angle of about 180 degrees with respect to each other in a direction perpendicular to a direction of a length of crimping terminals mounted on said housings, and are disposed in inverted relation to each other.

5. A crimping connector according to claim 1, in which a cover for covering an upper side of said wire connecting portion of said housing to be disposed in an uppermost stage is integrally connected to said uppermost housing through a hinge portion.

6. A crimping connector according to claim 2, in which a cover for covering an upper side of said wire connecting portion of said housing to be disposed in an uppermost stage is integrally connected to said uppermost housing through a hinge portion.

7. A crimping connector according to claim 3, in which a cover for covering an upper side of said wire connecting portion of said housing to be disposed in an uppermost stage is integrally connected to said uppermost housing through a hinge portion.

8. A crimping connector according to claim 4, in which a cover for covering an upper side of said wire connecting portion of said housing to be disposed in an uppermost stage is integrally connected to said uppermost housing through a hinge portion.

9. A crimping connector according to claim 5, in which said plurality of housings and said cover are integrally connected together through said hinge and said hinge portion so that they can be pivotally moved in the same direction to be stacked together.

10. A crimping connector according to claim 5, in which said cover has a projection for pressing against sheathed wires, connected to said uppermost housing, when said cover covers said wire connecting portion of said uppermost housing.

11. A crimping connector according to claim 2, in which said plurality of housings are integrally connected together through said hinge in such a manner that any two adjacent housings are disposed at an angle of about 180 degrees with respect to each other in a direction perpendicular to a direction of a length of crimping terminals mounted on said housings, and are disposed in inverted relation to each other.

12. A crimping connector according to claim 11, in which a cover for covering an upper side of said wire connecting portion of said housing to be disposed in an uppermost stage is integrally connected to said uppermost housing through a hinge portion.

13. A crimping connector according to claim 6, in which said plurality of housings and said cover are integrally connected together through said hinge and said hinge portion so that they can be pivotally moved in the same direction to be stacked together.

14. A crimping connector according to claim 6, in which said cover has a projection for pressing against sheathed wires, connected to said uppermost housing, when said cover covers said wire connecting portion of said uppermost housing.

15. A crimping connector according to claim 1, in which a projection is formed on each of said plurality of housings except said lowermost housing, and each of said projections is for pressing against sheathed wires connected to said housing disposed beneath said projection when said plurality of housings are stacked together.

16. A method of producing a crimping connector comprising: a plurality of housings each including an upwardly-open wire connecting portion and a terminal connecting portion of a closed cross-sectional shape communicating with said wire connecting portion; and a hinge for integrally connecting said housings so that said wire connecting portions of said housings, as well as said terminal connecting portions thereof, can be stacked one upon another vertically in the same position and the same direction, said method comprising the following steps in the sequence set forth:

crimping sheathed wires to the wire connecting portion of a lower housing from an upper side;

turning an upper housing around the hinge so that it is superposed on the lower housing; and crimping sheathed wires to the wire connecting portion of the upper housing from an upper side.

17. A method of producing a crimping connector according to claim 16, wherein said crimping connector further comprises: a cover, for covering an upper side of said wire connecting portion of said upper housing, integrally connected to said upper housing through a hinge portion, said method further comprising, as a last step:

turning said cover around the hinge portion so that it is superposed on the upper housing.

* * * * *